US008053055B2

(12) United States Patent
Papadopoulos et al.

(10) Patent No.: US 8,053,055 B2
(45) **Date of Patent: *Nov. 8, 2011**

(54) STRETCH FILM

(75) Inventors: Georgios Papadopoulos, Crete (GR); Damianos Markakis, Crete (GR); Anthony G. Karandinos, Crete (GR)

(73) Assignee: Megaplast S.A., Crete (GR)

( * ) Notice: Subject to any disclaimer, the term of this patent is extended or adjusted under 35 U.S.C. 154(b) by 1094 days.

This patent is subject to a terminal disclaimer.

(21) Appl. No.: 11/630,226

(22) PCT Filed: Jul. 16, 2004

(86) PCT No.: PCT/EP2004/007965

§ 371 (c)(1),
(2), (4) Date: Dec. 20, 2006

(87) PCT Pub. No.: WO2006/018028

PCT Pub. Date: Feb. 23, 2006

(65) Prior Publication Data

US 2008/0280098 A1 Nov. 13, 2008

(51) Int. Cl.
*B32B 3/24* (2006.01)

(52) U.S. Cl. ..... 428/137; 428/131; 428/138

(58) Field of Classification Search ..... 428/131, 428/137, 138

See application file for complete search history.

(56) References Cited

U.S. PATENT DOCUMENTS

| | | | | |
|---|---|---|---|---|
| 4,758,297 | A * | 7/1988 | Calligarich | 156/251 |
| 5,520,872 | A * | 5/1996 | Scherer | 264/285 |
| 5,935,681 | A * | 8/1999 | Paulett | 428/137 |
| 2005/0118391 | A1 * | 6/2005 | Kavvadias et al. | 428/131 |
| 2005/0123721 | A1 * | 6/2005 | Heikaus et al. | 428/137 |

FOREIGN PATENT DOCUMENTS

| | | | |
|---|---|---|---|
| DE | 10007614 | | 8/2001 |
| EP | 0816056 | | 1/1998 |
| EP | 0820856 | | 10/2000 |
| EP | 0909721 | | 4/2003 |
| EP | 0999037 | | 2/2005 |
| WO | WO 01/60709 | | 8/2001 |
| WO | WO 01/91997 | | 12/2001 |
| WO | WO 02/094674 | | 11/2002 |
| WO | WO 03/059750 | | 7/2003 |
| WO | WO 03059750 | A2 * | 7/2003 |
| WO | WO 2004/080695 | | 9/2004 |

* cited by examiner

*Primary Examiner* — William P Watkins, III

(74) *Attorney, Agent, or Firm* — D. Peter Hochberg; Sean F. Mellino; Daniel J. Smola

(57) ABSTRACT

A stretch film comprising a base film made of a stretchable plastic film material, a multiplicity of holes in the base film arranged in several columns along a main direction, at least one reinforcement strip made of a stretchable plastic film material. The reinforcement strip is arranged and fixed on the base film in an area between two adjacent columns of holes. The thickness of the base film is greater than or equal to the thickness of the reinforcement strip and the width (w) of the reinforcement strip is as great as possible, but is such that the reinforcement strip does not contact or overlap the holes in the adjacent columns of holes. The reinforcement strip may be fixed to the base film so as to be inseparable and indistinguishable from the base film.

41 Claims, 8 Drawing Sheets

STRETCH FILM

CROSS-REFERENCE TO RELATED APPLICATIONS

This application is a National Stage application of International Application No. PCT/EP04/007965, filed on Jul. 16, 2004.

BACKGROUND OF THE INVENTION

1. Field of the Invention

The present invention relates to a stretch film. In particular, the present invention relates to a stretch film product for palletizing.

2. Description of the Prior Art

For packing or wrapping pallets, bales of straw, fruit etc. it is known that perforated plastic stretch films are used in order to provide sufficient stretchability of the packaging film as well as ventilation of the products to be packed. Known from EP 0 820 856 A1 is a pre-stretched plastic stretch film in which holes are formed by a thermal irradiation method without contacting the film and thus without waste of film material, for example, caused by punching out holes.

Known from EP 0 909 721 A1 is a perforated extensible palletizing film comprising a longitudinally elongated thin sheet of extensible plastics provided with ventilation holes and longitudinal reinforcement elements which are made of extensible plastics and are adapted to increase the strength of the film in the pulling direction.

Similar perforated stretch films are known from WO 01/60709 A1 and WO 02/094674 A1.

The perforations of these stretch films represent a macro perforation in which holes having a diameter of at least 5 mm are provided in a base film. Films with significantly smaller perforations represent a micro perforation and are irrelevant to the present invention.

The above should not be confused with film products on which slits or small punctures have been made initially with the intention that these increase, break or open (resulting in large openings) as a result of the film being stretched during usage in a wrapping machine with a prestretching system.

In practice, a number of problems may arise in connection with the above-described macro-perforated stretch films comprising reinforcing elements. Namely, the stretch films are normally used by automatic or semi-automatic stretch wrapping machines, for example, in order to wrap products stacked on pallets. To ensure good material utilization, it is desirable to stretch the stretch film during the wrapping operation by e.g. 100 to 250% as compared to the stock of film material still on a winding drum. To this end, considerable force is required which can be significantly increased by reinforcing elements fixed onto the stretch film, so that in the end the wrapping machine, under special conditions, is no longer capable of providing sufficient stretching of the stretch film for lack of sufficient power.

On the other hand, if the wrapping machine is strong enough to provide the desired stretching, there is the danger that the forces acting on the products to be wrapped are too great. If the products are, for example, boxes, there is the risk that the stretch film and/or the reinforcing elements fixed thereto, press the products or their packages together and damage them.

Further there is the danger that the additional reinforcing elements have not been fixed onto the base film by the manufacturer with sufficient reliability. In this case the respective reinforcement element which, for example, is formed as an elongated plastic film strip, can detach itself from the carrier film and become engaged in a nip roll of a wrapping machine, thereby obstructing the film feed path.

In addition, it has been found in the case of the films known from the prior art that the respective carrier films or base films hardly contributes to strength. Basically, they serve rather only to carry the reinforcement elements, which predominantly ensure the desired strength. Accordingly, the material of the base film is utilized insufficiently.

The reinforcement elements fixed onto the base film may convey to the observer an impression of poor optical properties and poor appearance of a pallet wrapped in the stretch film, thereby detracting from the overall impression of the pallet and the valence of the products stacked thereon.

SUMMARY OF THE INVENTION

It is the object of the present invention to provide a stretch film in which a control of the product variables, in particular with respect to strength and stretchability is achieved, with optimal material utilization. In this connection it is not important to obtain maximum strength or stretchability, but rather to achieve reliably the given parameters with a minimum of material involved.

In a stretch film of a first embodiment according to the invention, there is provided a base film of a stretchable plastic material in which a multiplicity of holes are arranged in several columns along a main direction. At least one reinforcement strip made of a stretchable plastic film material is arranged and fixed on the base film in an area between two adjacent columns of holes. The thickness of the base film is greater than or equal to the thickness of the reinforcement strip.

As described above, reinforcement elements (mostly strips or bands of similar film material) are fixed onto the prior art stretch films in order to reinforce the finished product as much as possible. In this case the reinforcement elements are normally thicker than the base film which only serves as a carrier. For example, WO 01/60709 A1 describes that the reinforcement element should be folded several times along its longitudinal direction to provide maximum strength in an area of contact between the reinforcement element and the base film, the area of contact being as small as possible.

It has turned out now that in the prior art stretch films having a thin base film and a strong reinforcement strip, tears may form in the base film whose continuation is hindered by the stronger reinforcement elements. However, the tears spread rapidly in the base film and cause damage to the film so that the whole stretch film is rendered unusable.

Thus the stretch film is destroyed although owing to their rather robust design the reinforcement elements possibly have considerable reserves of strength and stretchability.

The present invention prescribes that the thickness of the base film should be greater than the thickness of the reinforcement strip. Thus it is possible to make the base film strong enough at least to prevent untimely tearing. If finally—after reaching or exceeding the preselected strength limit—a tear forms nevertheless in the base film, this tear can extend in the weaker reinforcement elements. Thus the material utilization is altogether considerably better than in the stretch films known from prior art.

Moreover, a thicker base film and a thinner reinforcement strip allows for a more even force distribution along the width of the stretch film. Thus, a better distribution of the pressure that acts on the products wrapped in the pallet can be achieved and there is a smaller probability that the products are damaged due to excess force (as it is often the case with stretch films known from prior art).

According to a further variant of the invention, the width of the reinforcement strip is as great as possible, but such that the reinforcement strip does not contact or overlap the holes in the adjacent columns of holes.

This means that the reinforcement strips should be as wide as possible without, however, impairing the air permeability of the film via the holes.

WO 03/059750 already describes that the reinforcement strips should extend as far as the adjacent columns of holes. However, it has been found that in particular when the holes are formed with the aid of a thermal irradiation method, material accumulates around the holes. EP 0 820 845 A1 describes that by the thermal irradiation method in which a hole is formed without contacting the film, each hole is surrounded by a bulge in the form of a lip. The lip of the base film first has a thickness greater than that of the other areas of the base film, thereby causing material of the base film to accumulate around the hole. Only by stretching after the formation of the holes, can the accumulated material be reduced again, because the material then flows into the more strongly stretched regions in the vicinity of the lip. The lip thus causes an intended reinforcement of the film in the region of the hole so that an overlap of the lip by the reinforcement strip may possibly not provide any advantages.

Therefore, it is of special advantage if the width of the reinforcement strip is dimensioned so that the reinforcement strip does not overlap the lips. The width of the reinforcement strip should rather be such that the reinforcement strip extends as far as the lips without contacting them.

In this way it is ensured that considerable portions of the base film are covered with the reinforcement strip. Should a tear form in the base film owing to high stress acting on the stretch film, this tear can continue only to a very limited extent because it is stopped by the material accumulation in the region of the lips and/or at the reinforcement strips. Thus the overall strength of the stretch film can be improved without additional material being required.

It is of special advantage if the ratio of thickness to width of the reinforcement strip is as small as possible. In this way, the material can be optimally utilized by observing the above rule, namely that the width of the reinforcement strips should be as great as possible.

A reinforcement strip is provided between each two columns of holes, and also the respective marginal areas of the base film are covered with a reinforcement strip. As explained above, it is of special importance that the surfaces of the regions which are not covered be as small as possible to prevent tearing from the outset as well as continuation of the tears. Only in the surroundings of the holes may there be regions which are not covered with reinforcement elements.

For a further improvement it may be of advantage that the reinforcement strip and the lateral edge of the base film are hemmed together. This hemming of the lateral edges of the stretch film ensures additional reinforcement to prevent tearing at the edges.

Another embodiment of the invention has only the lateral edges of the base film hemmed, without the corresponding reinforcement strips. The hemming of the lateral edges of the base film also provides for a reinforcement at the edges.

It is of special advantage that the reinforcement strip is fixed to the base film in such a way that it is inseparable from the base film. In this way the risk of detachment of the reinforcement strip is reduced. As described above, there is the problem in practice that the reinforcement strips detach themselves from the carrier material (base film), thereby obstructing the automatic wrapping machines.

According to a further advantageous development of the invention, the reinforcement strip is indistinguishable from the base film, thereby improving at least the optical appearance and the impression of valence of the stretch film so that in practice the overall impression of the products wrapped in the stretch film is improved.

It is particularly advantageous that in the area of contact between the reinforcement strip and the base film, an interfacial area is provided in which conditions have been met so that an interfacial polymer chain mixing has occurred. Thus, a strong interface is formed between the reinforcement strip and the base film as a result of surface rearrangement, surface change and subsequent molecular interdiffusion, intercrystallization and solidification. This very advantageous polymer chain adhesion can be obtained especially when the reinforcement strip is applied to the base film at an increased temperature, e.g. 50-90 degrees Celsius (thermal bonding or laminating method). To this end it is necessary that the temperature of the film be high, but below the melting point of the film material (e.g. LLDPE). The temperature should preferably be allowed to have its effect for a certain time in order to obtain the desired polymer chain mixing in the interfacial area. The polymer chain mixing process can be promoted by pressure acting on the base film and the reinforcement strip. The required pressure can be applied, for example, by nip rollers.

The interfacial area (diffusion area) ensures that the base film and the reinforcement strips carried thereby are inseparably joined together and will from then on act as one unit.

It is of special advantage that a transition region extending from the lateral edge of the reinforcement strip to the base film is smooth, and in particular without any notches. Thus a soft and smooth transition from the reinforcement strip to the base film is achieved which in the absence of notches offers no possibility for the formation of tears and increased tension.

In order to achieve optimum interaction between the base film and the reinforcement elements, the reinforcement elements should be applied as smoothly as possible, without producing wrinkles on the base film and/or the reinforcement strip itself. Besides this procedure also promotes the formation of the above-described interfacial area (diffusion area).

These and other features of the invention are explained in detail below in examples with reference to the appended drawings.

BRIEF DESCRIPTION OF THE DRAWINGS

FIG. 6(*b*) a cross section of the stretch film of FIG. 6(*a*).

FIG. 7(*b*) a cross section of the stretch film of FIG. 7(*a*).

FIG. 8(*b*) a cross section of the stretch film of FIG. 8(*a*).

DETAILED DESCRIPTION OF THE INVENTION

Note that in all pictures of cross sections the thickness is shown out of proportion compared to the width of the film for illustration purposes.

Figure 1:
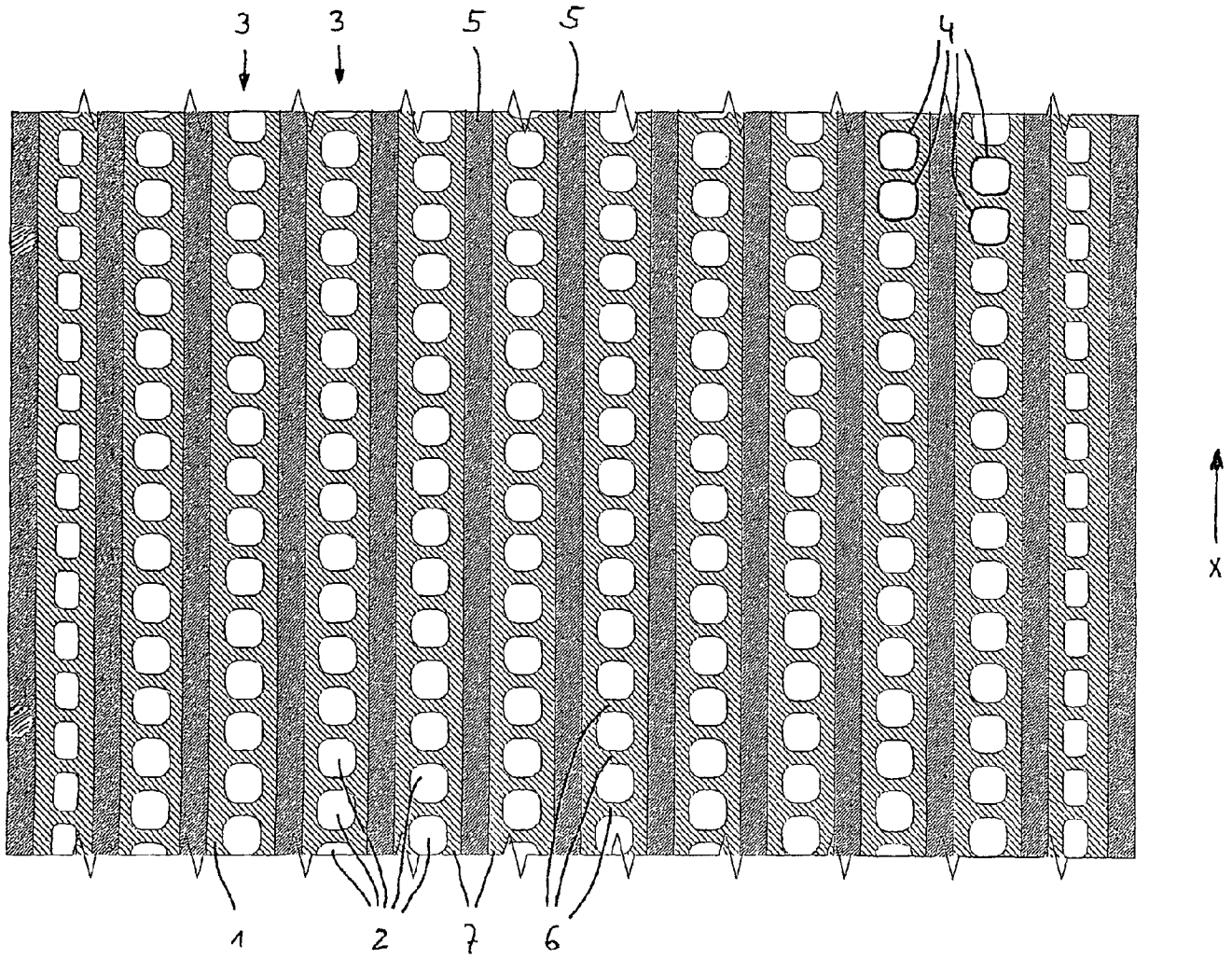
FIG. 1 is a top view of a portion of the stretch film of the invention in an unstretched or slightly stretched state (e.g. 0-30%).

FIG. 1 shows the stretch film of the invention in an unstretched or slightly stretched state.

In a base film 1 made of a film material (e.g. LLDPE) and serving as a carrier, there are formed a multiplicity or plurality of holes 2 in the form of several substantially parallel columns of holes 3 extending in a main direction X, for example, with the aid of the method described in EP 0 820 856 A1. The base film 1 is of great length and may be wound on and off in the direction X.

Figure 4:
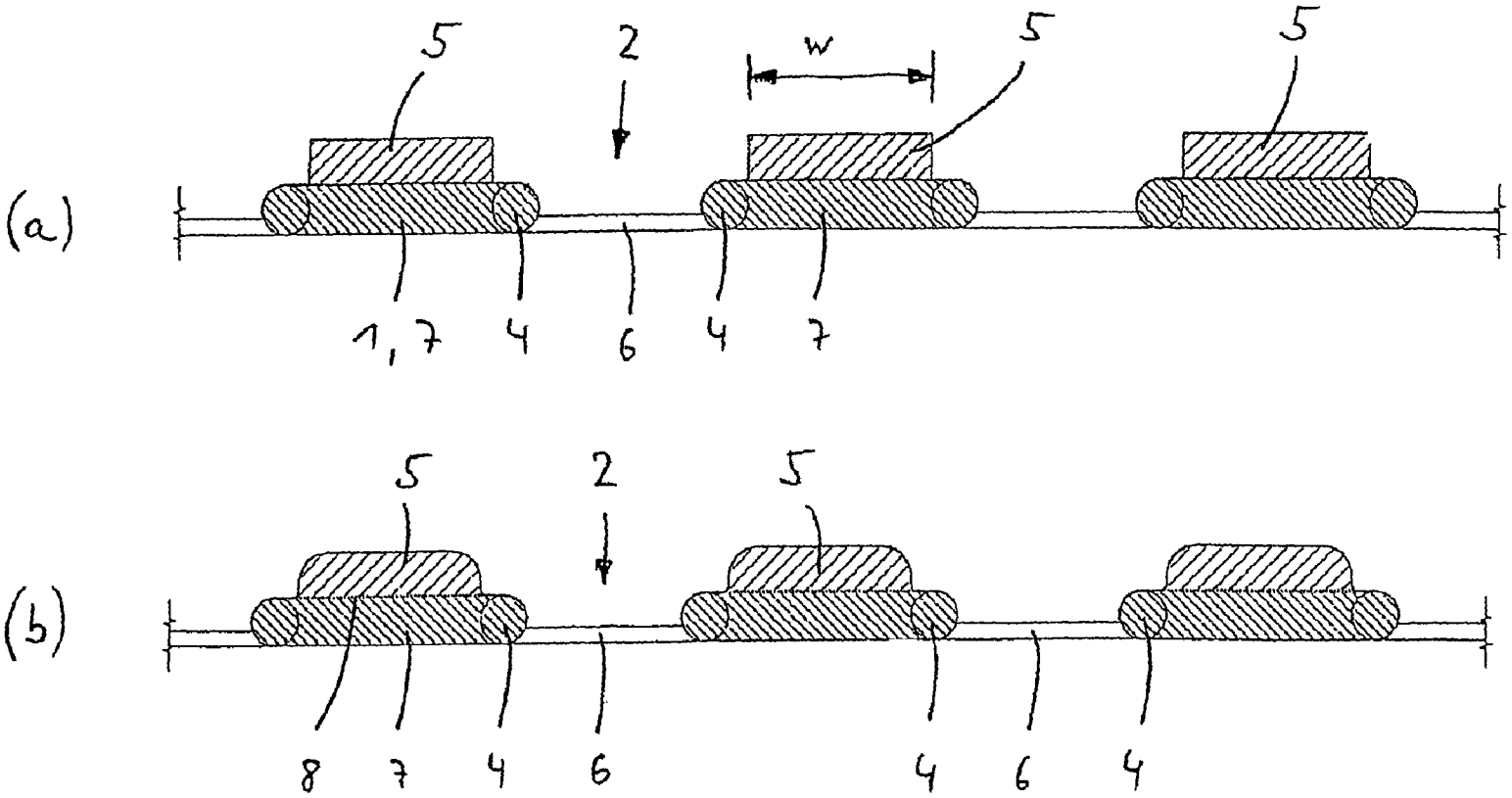
FIG. 4 is a cross-section through the stretch film of FIG. 1 before (a) and after (b) a thermal laminating method has been carried out.

FIG. 4(*b*) is a cross-section through the stretch film of FIG. 1.

According to the process of manufacture of the holes 2 as described in EP 0 820 856 A1, after thermal treatment, bulges referred to as lips 4 form which surround each hole 2 with a thickness greater than the thickness of the base film 1 at least prior to further stretching. The lip 4 allows stronger stretching of the film around the hole 2 without the formation of tears at the edge of the hole 2. The lip 4 rather forms a material stock so that plastic material may flow from the lip 4 into adjacent regions in which, due to stretching, increased tensions appear. These tensions are alleviated by the flow of material from the lip 4 to the adjacent regions, thus allowing the perforated plastic film to stretch without breaking.

Fixed on the base film 1 between the columns 3 of holes 2 are reinforcement strips 5. These reinforcement strips 5 are also made of stretch film material such as LLDPE. They extend in the direction of the main direction (X). Their width (w) is dimensioned such that they extend as far as the columns 3 of holes 2 adjacent thereto, but without contacting or even overlapping the holes 2. Ideally, the strips 5 end precisely where the material accumulation of the lip 4 begins, as is shown in FIG. 4.

In FIG. 4 (as well as in FIGS. 5 to 8) the lip 4 is shown as having the same thickness as the base film 1. However, as mentioned previously, the lip 4 may also have a thickness greater than that of the base film 1 especially if the stretch film has not been subjected to stretching along the main direction (X) or a direction transverse to the main direction.

The strips 5 thus should have a maximum width without extending beyond the lip 4. The reason therefor is that the lip 4 already forms an accumulation of material so that further material in the same location provided by an overlapping reinforcement strip 5 would not only be unnecessary but would impair at least the optical overall impression. But if the reinforcement strip 5 extends in width precisely between the lips 4 of two adjacent columns (rows) 3 of holes 2, it will fill up material in those regions in which material has not accumulated yet, so that a reinforcement, as intended, is achieved.

The thickness of a reinforcement strip 5 is subject to two conditions: On the one hand, the width of the reinforcement strip 5 is predetermined by the above rule, namely a width as great as possible without contacting the lips 4. On the other hand, the reinforcement strip 5 should obtain a predetermined strength and stretchability from which results in turn the thickness of the reinforcement strip 5.

In the outer marginal regions of the base film 1 (in FIG. 1 on the left and right outer edge), respective reinforcement strips 5 cover the top of the base film 1 by extending as far as its edges, thereby preventing tearing at the lateral edges. For the purpose of further reinforcement, the marginal regions of the base film 1 may be hemmed together by folding the base film 1 together with the reinforcement strip 5 applied to the edge.

As already described above, the stretch film shown in FIG. 1 may be slightly pre-stretched in the main direction X and the transverse direction. Normally, the holes 2 will be circular, if they are formed contactless by means of the above-described thermal method. But subsequent stretching of the film during the process of manufacture in the main direction and the transverse direction results in the four-cornered basic shape of the holes 2 illustrated in FIG. 1 and described, for example, also in WO 01/91997 A1. In this case transverse stretching is taken over in particular by bridges 6 provided between adjacent holes 2 of a column 3 of holes.

Figure 2:
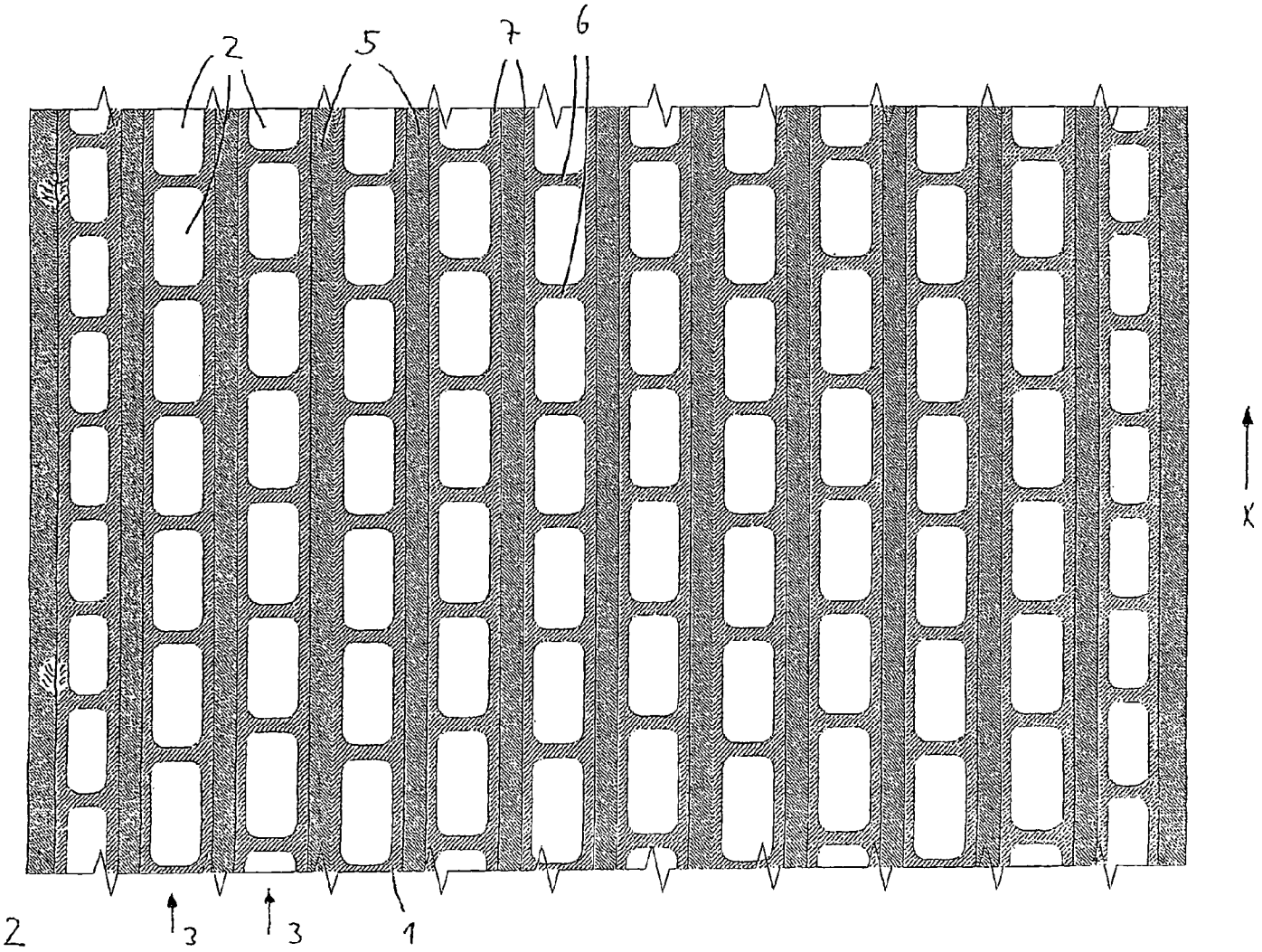
FIG. 2 shows the stretch film of FIG. 1 in a moderately stretched state (e.g. 50-150%).

FIG. 2 shows the stretch film of FIG. 1, but pre-stretched in the main direction X by, e.g. 50 to 150%. Accordingly, the holes 2 in particular in the main direction X have become larger while the bridges 6 have become narrower. So called main strips 7, which are also part of the base film 1 and on which the reinforcement strips 5 extend, have become narrower transversely of the main direction X. Hence the base film 1 is formed by the main strips 7 extending in the main direction X and the bridges 6 extending transversely thereof, thereby providing a certain net-shaped structure.

Figure 3:
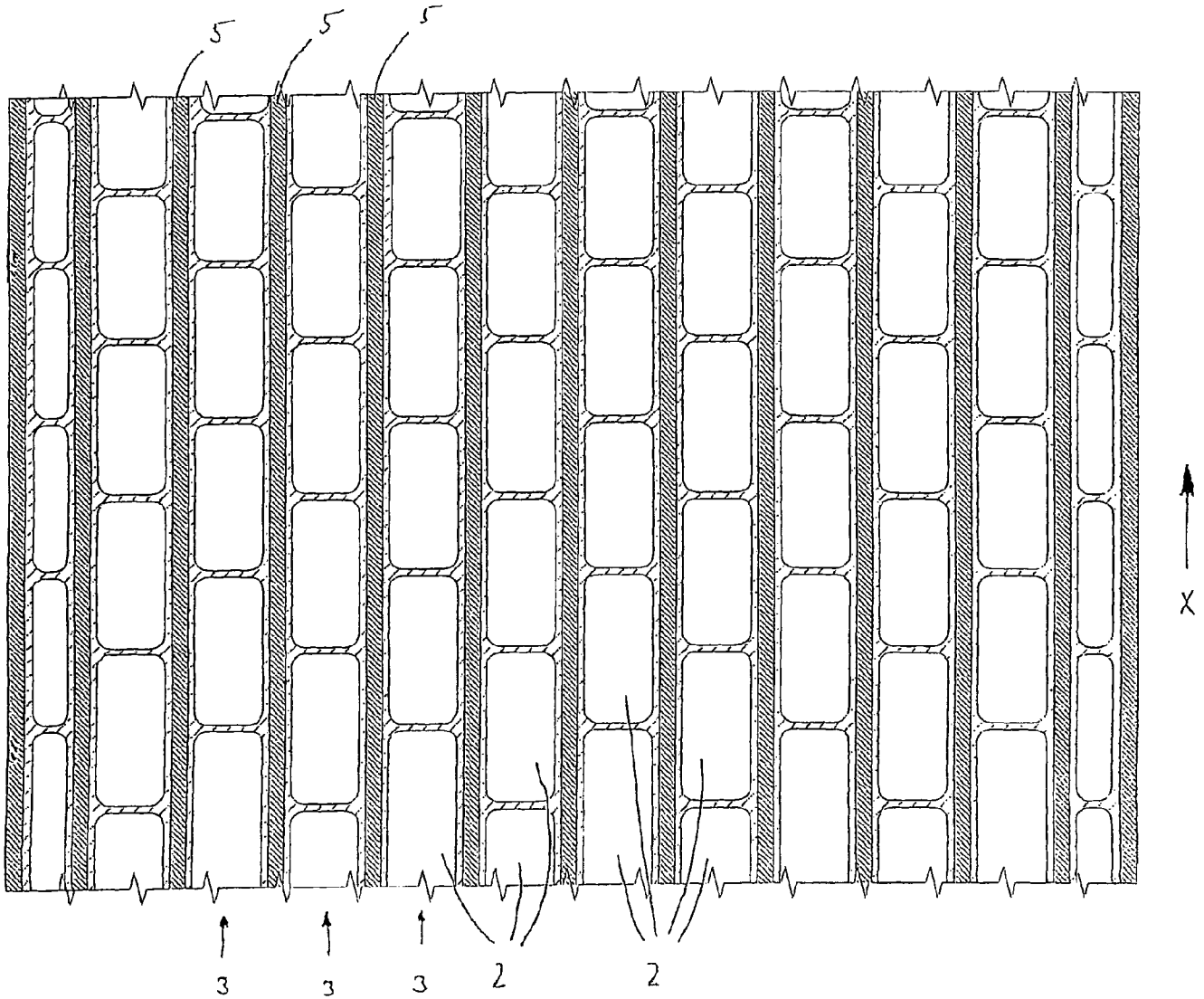
FIG. 3 shows the stretch film of FIG. 1 in a strongly stretched state (e.g. 200-300%).

The stretch film of FIG. 3 is also based on the stretch film of FIG. 1. But is was subjected to even stronger stretching (e.g. 200-300%) in the main direction X. The result is a net which is suited not only for palletizing but even for wrapping bales of straw. Owing to the large surface portion occupied by the holes 2, excellent material utilization, as well as pallet ventilation is possible. But nevertheless sufficient strength is ensured by the reinforcement strips 5 extending on each main strip 7.

It is desirable when fabricating the stretch film that large portions of the base film 1 be covered with a reinforcement strip 5. Merely the bridges 6 between the main strips 7 and the portions of the main strips 7 coinciding with the lips 4 need not be covered with a reinforcement strip 5.

FIG. 4(*a*) is a cross-section through the stretch film of FIG. 1, in which a reinforcement strip 5 has been placed on the associated main strip 7 but has not yet been thermally bonded. FIG. 4(*b*) is the same cross-section but after thermal bonding. In the area of contact between the reinforcement strip 5 and the main strip 7 provided therebelow, an interfacial area 8 shown by dotted lines has formed in which polymer chains on the surface of the reinforcement strip 5 and polymer chains on the surface of the main strip 7 have partially blended (combined, mixed), thereby causing an intimate connection of the reinforcement strip 5 with the main strip 7 so that separation of the two strips 5, 7 is no longer possible. Neither the strips 5, 7 can be distinguished from each other by the naked eye.

The method of thermal bonding for joining the reinforcement strips 5 to the respectively associated main strips 7 resides in that the strips 5, 7 are joined together under the action of pressure and temperature. The temperature should be as high as possible but below the melting temperature in order to obtain the required movability of the molecules. Too high a temperature would impair the elasticity and stretching characteristics of the film.

It can also be seen from FIG. 4 that the bridges 6 connecting the main strips 7 have a thickness less than that of the main strips 7 themselves. The reason therefor is that the stretch film is already transversely stretched during its fabrication, transverse stretching (transversely of the main direction X) causing above all stretching of the bridges 6 and thus reduction of their thickness.

It should be noted that if the stretch film or the bridges are not pre-stretched in a direction transverse to the main direction (X), then their thickness will be greater than or equal to the thickness of the base film. This is also a possible embodiment of the invention which is not shown merely for purposes of economy.

Figure 5:
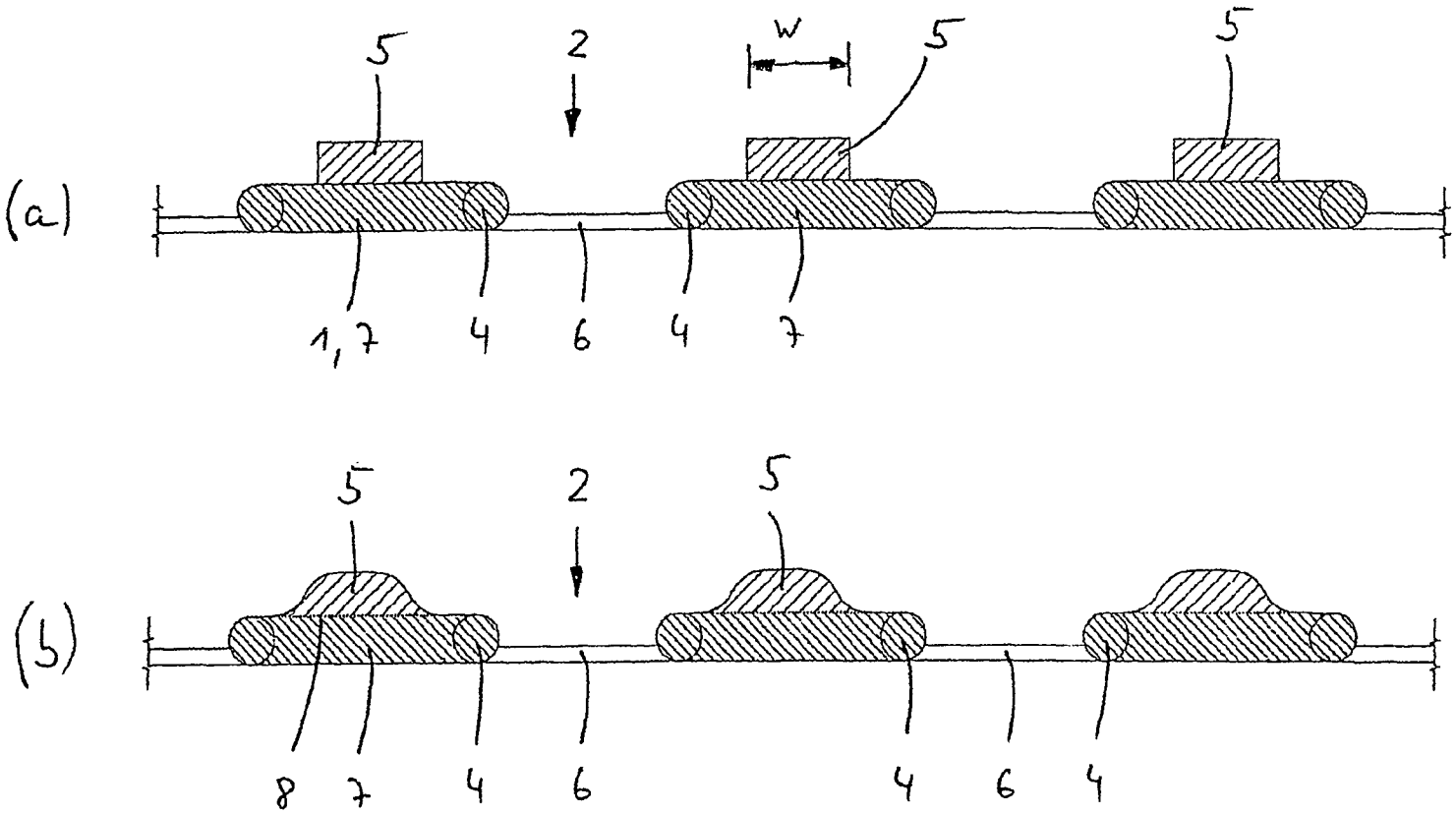
FIG. 5 is a sectional view of a further embodiment of the stretch film of the invention, corresponding to FIG. 4.

FIG. 5 is a cross-section through a further stretch film which is similar to that of FIG. 1. Therefore, FIG. 5 is substantially identical with FIG. 4.

But the width (w) of the reinforcement strips 5 is less than in FIG. 4.

While in FIG. 5(*a*) the width (w) is not maximum, i.e. is not dimensioned so that the reinforcement strips 5 extend as far as the lips 4, it can be seen from FIG. 5(*b*) that after thermal bonding, the film material has flown in such a way that the reinforcement strips 5 almost reach the lips 4. The transition from the marginal areas of the reinforcement strips 5 to the base film 1 is very smooth without any notches or even undercuts and/or gaps being recognizable in the area of contact between the reinforcement strips 5 and the base film 1.

In the embodiment of FIG. 4(*b*) a smooth transition between the reinforcement strips 5 and the base film 1 may or should be achieved.

Figure 6:
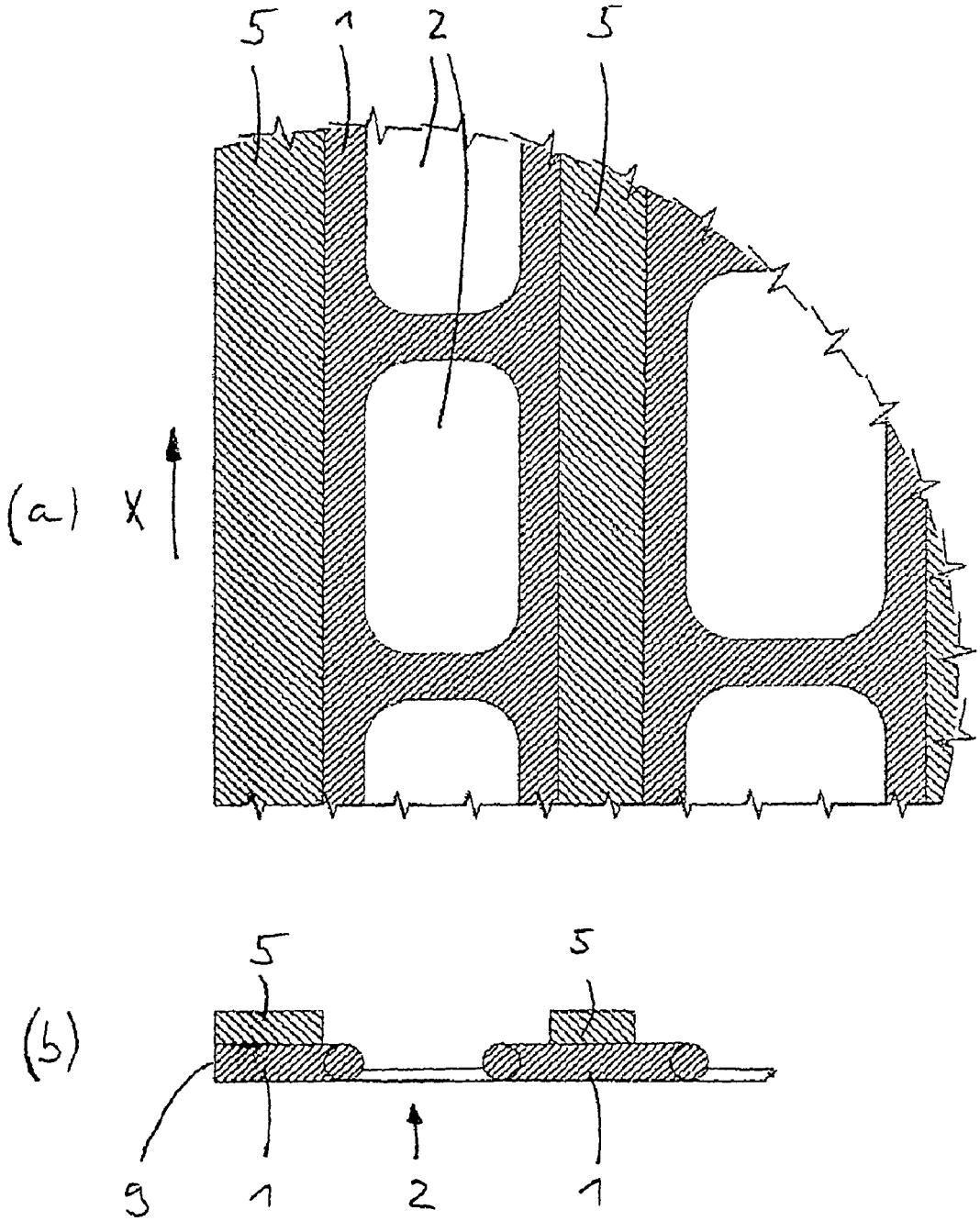
FIG. 6(*a*) a top view of a lateral edge portion of the stretch film.
Figure 7:
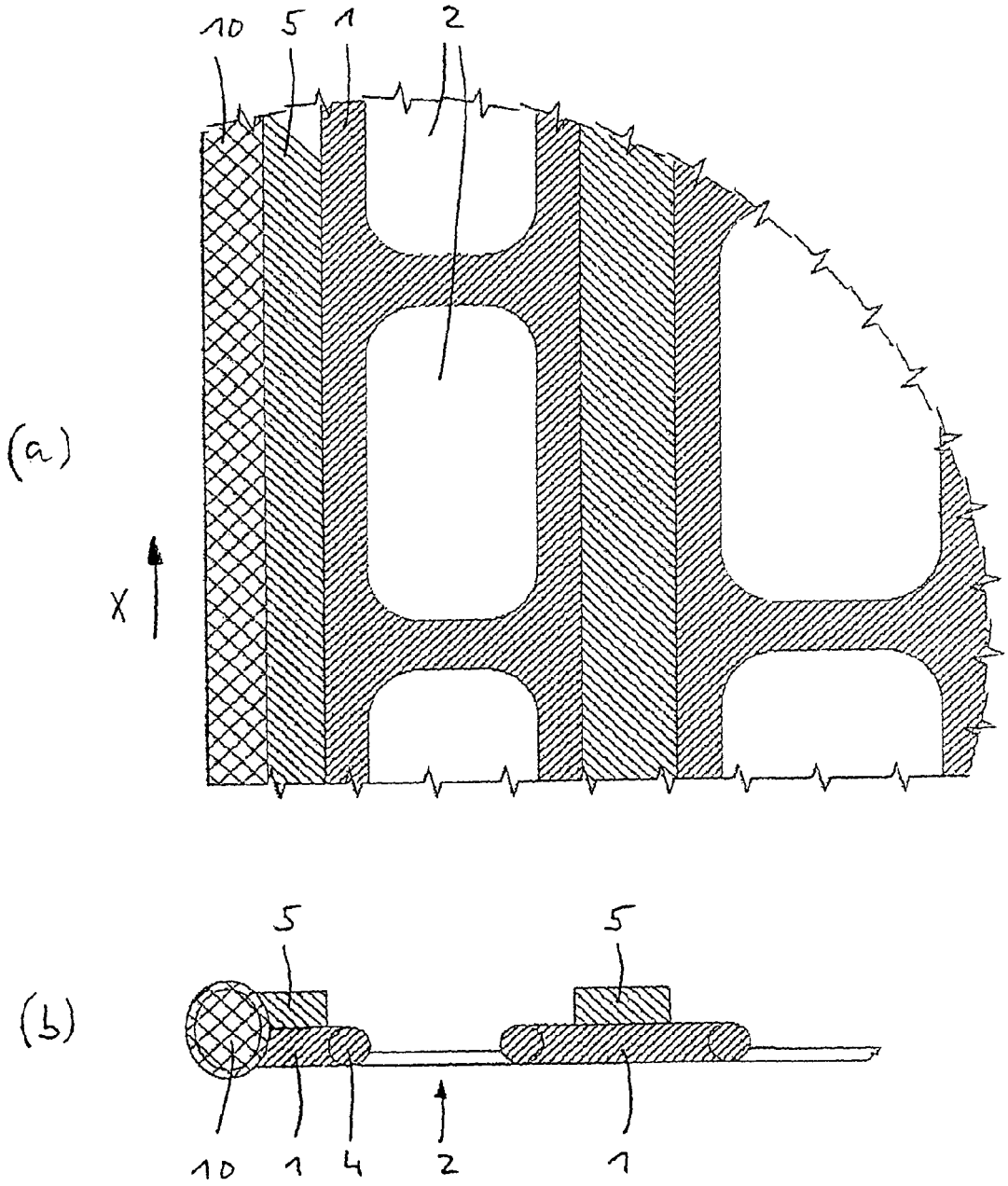
FIG. 7(*a*) a top view of a further embodiment of a lateral edge portion of the stretch film.
Figure 8:
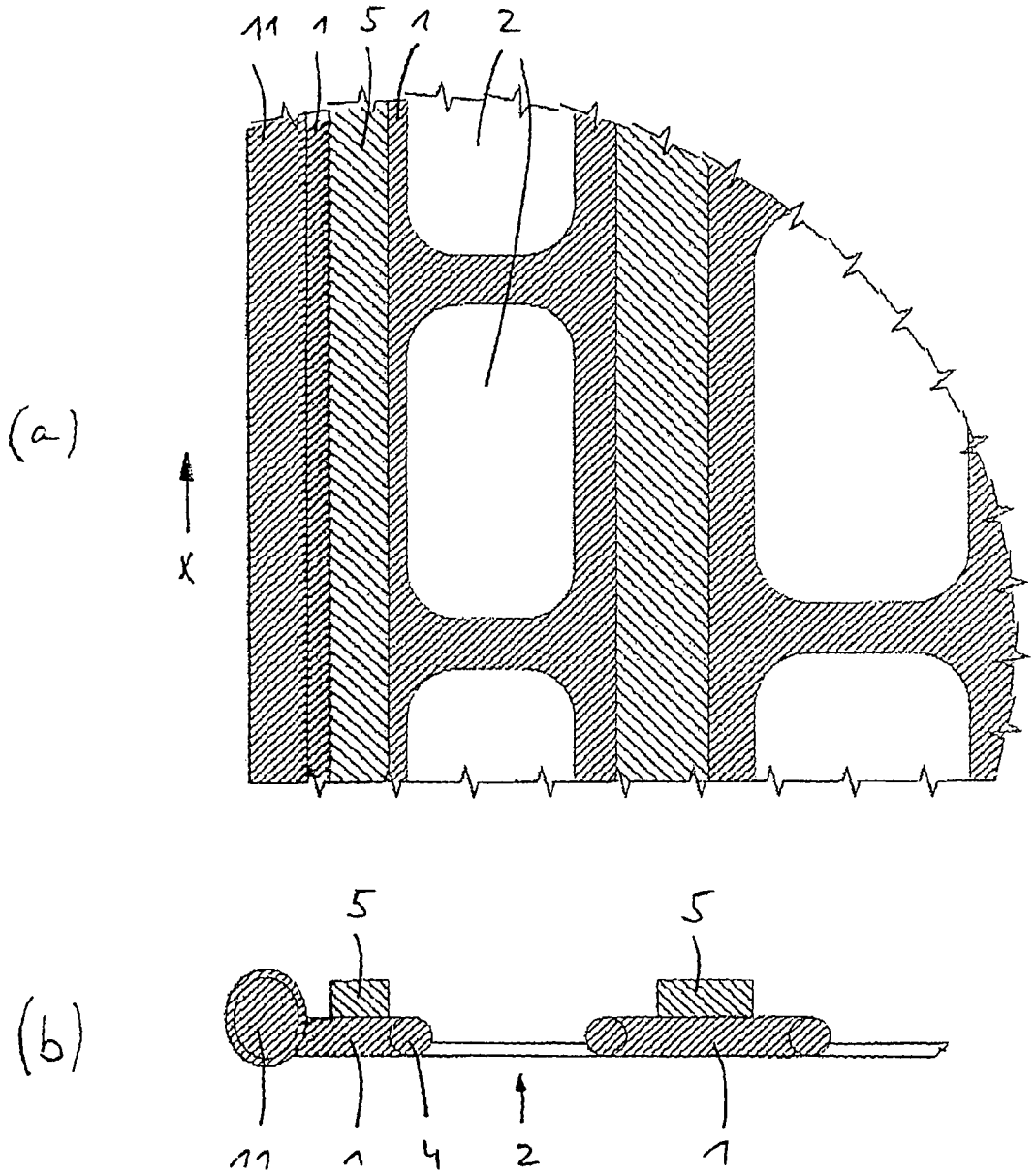
FIG. 8(*a*) a top view of a still further embodiment of a lateral edge portion of the stretch film.

FIGS. 6 to 8 are all based on the embodiment of FIG. 2. However, the principles described in FIGS. 6 to 8 can be also encountered with the embodiments of FIGS. 1 and 3 as well as all other embodiments of the invention deriving from the claims or a combination of the claims. Moreover, the cross-sectional pictures in FIGS. 6 to 8 show the reinforcement strips 5 as they would appear before a thermal lamination procedure, solely for the purpose of a clear illustration.

FIG. 6(*a*) shows a top view of a lateral edge region of a stretch film shown in FIG. 2, whereas FIG. 6(*b*) is a cross section of the stretch film part shown in FIG. 6(*a*). The reinforcement strip 5 extends to a lateral edge 9 of base film 1.

FIG. 7 shows another embodiment of the invention which is also based on the embodiment shown in FIG. 2. FIG. 7(*a*) is a top view and FIG. 7(*b*) a cross section of this other embodiment.

The only difference between the embodiment shown in FIG. 7 and the embodiment shown in FIG. 2 is such that the margins of base film 1 and reinforcement strip 5 are hemmed, i.e. folded together forming a hemming zone 10.

FIG. 8 shows still another embodiment of the invention which is also based on the embodiment shown in FIG. 2. FIG. 8(*a*) is a top view and FIG. 8(*b*) is a cross section of the further embodiment.

The difference between the embodiment of FIG. 8 and the embodiment of FIG. 7 is such that the reinforcement strip 5 does not extend to the lateral edge of base film 1. Rather, as can be depicted from FIG. 8(*b*), the width of reinforcement strip 5 is dimensioned such that it does not reach the lateral edge of base film 1. The lateral edge of base film 1—and not reinforcement strip 5—is hemmed for forming a hemming zone 11.

The hemming zone 10 shown in FIG. 7 includes both the base film 1 and the reinforcement strip 5, whereas the hemming zone 11 of FIG. 8 includes only the base film 1.

It may be that the base film 1 (and the reinforcement strip 5 in FIG. 7) are folded for forming a smooth hemming zone without any wrinkles. It is also possible that the formation of the hemming zones 10, 11 results in a wrinkled and folded area.

What has been described above are preferred aspects of the present invention. It is of course not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, combinations, modifications, and variations that fall within the spirit and scope of the appended claims.

The invention claimed is:

1. A stretch film comprising:

a base film comprising a stretchable plastic film material, said base film having a main direction and a thickness;

a plurality of holes in said base film arranged in several columns along said main direction to form a plurality of columns of holes; and at least one reinforcement strip having a thickness and a width comprising a stretchable plastic film material, said at least one reinforcement strip being arranged and fixed on said base film in an area between two adjacent columns of said plurality of columns of holes;

wherein the thickness of said base film is greater than the thickness of said at least one reinforcement strip.

2. The stretch film according to claim 1, wherein the width of said at least one reinforcement strip is as great as possible with respect to said adjacent columns of holes, and wherein said at least one reinforcement strip does not contact or overlap said holes of said adjacent columns of holes.

3. A stretch film comprising:

a base film comprising a stretchable plastic film material, said base film having a main direction and at least one lateral edge;

a plurality of holes in said base film, arranged in several columns along said main direction; and at least one reinforcement strip having a width and a thickness and comprising a stretchable plastic film material, said at least one reinforcement strip being arranged and fixed on said base film in an area between two adjacent columns of said plurality of columns of holes;

wherein the width of said at least one reinforcement strip is as great as possible with respect to said adjacent columns of holes, and wherein said at least one reinforcement strip does not contact or overlap said holes of said adjacent columns of holes;

wherein the thickness of said base film is greater than the thickness of said at least one reinforcement strip.

4. The stretch film according to claim 1, wherein a lip surrounds each hole of said plurality of holes, said lip being formed by accumulated plastic film material of said base film; and wherein the width of said at least one reinforcement strip is dimensioned to prevent said at least one reinforcement strip from overlapping said lips.

5. The stretch film according to claim 4, wherein the width of said at least one reinforcement strip is dimensioned to extend said at least one reinforcement strip as far as said lips.

6. The stretch film according to claim 1, wherein said plurality of holes are formed by a thermal irradiation method without contacting said base film.

7. The stretch film according to claim 1, wherein the ratio of thickness to width of said at least one reinforcement strip is as small as possible.

8. The stretch film according to claim 1, wherein said at least one reinforcement strip is arranged between each two columns of said plurality of columns of holes.

9. The stretch film according to claim 1, wherein said at least one reinforcement strip is arranged between the outermost column of said plurality of columns of holes and said corresponding adjacent lateral edge of said base film.

10. The stretch film according to claim 1, wherein said at least one reinforcement strip is arranged on each lateral edge of said base film.

11. The stretch film according to claim 1, wherein said at least one lateral edge of said base film is hemmed.

12. The stretch film according to claim 10, wherein said at least one reinforcement strip and said at least one lateral edge of said base film are hemmed together.

13. The stretch film according to claim 10, wherein said at least one lateral edge of said base film and said at least one reinforcement strip are connected together in a substantially smooth manner, and without any wrinkles, and wherein said at least one reinforcement strip extends as far as said at least one lateral edge of said base film.

14. The stretch film according to claim 1, wherein said at least one reinforcement strip is inseparably fixed to said base film.

15. The stretch film according to claim 1, wherein said at least one reinforcement strip is indistinguishable from said base film.

16. The stretch film according to claim 1, wherein an interfacial area is provided in said area of contact between said at least one reinforcement strip and said base film, wherein said at least one reinforcement strip comprises polymer chains and said base film comprises polymer chains, said interfacial area being an area in which said polymer chains of said base film mix with said polymer chains of said at least one reinforcement strip.

17. The stretch film according to claim 1, wherein a transition area extends from said at least one lateral edge of said at least one reinforcement strip to said base film, and wherein said transition area is smooth and does not have any notches.

18. The stretch film according to claim 1, wherein said at least one reinforcement strip is thermally laminated to said base film.

19. The stretch film according to claim 1, wherein said at least one reinforcement strip is fixed to said base film in a substantially smooth manner, and without any wrinkles.

20. The stretch film according to claim 1, wherein said base film and said at least one reinforcement strip are pre-stretched in said main direction and/or in a transverse direction perpendicular to said main direction, before or after formation of said plurality of holes.

21. The stretch film according to claim 1, wherein said plurality of holes have at least one shape selected from the group of shapes consisting of substantially a four-cornered shaped and ellipsoid shape.

22. The stretch film according to claim 1, wherein a portion of said base film between two adjacent holes of said plurality of holes in the same column of said plurality of columns is stretched more than the rest of said base film in a direction perpendicular to said main direction.

23. The stretch film according to claim 3, wherein a lip surrounds each hole of said plurality of holes, said lip being formed by accumulated plastic film material of said base film; and wherein the width of said at least one reinforcement strip is dimensioned to prevent said at least one reinforcement strip from overlapping said lips.

24. The stretch film according to claim 23, wherein the width of said at least one reinforcement strip is dimensioned to extend said at least one reinforcement strip as far as said lips.

25. The stretch film according to claim 3, wherein said plurality of holes are formed by a thermal irradiation method without contacting said base film.

26. The stretch film according to claim 3, wherein the ratio of thickness to width of said at least one reinforcement strip is as small as possible.

27. The stretch film according to claim 3, wherein said at least one reinforcement strip is arranged between each two columns of said plurality of columns of holes.

28. The stretch film according to claim 3, wherein said at least one reinforcement strip is arranged between the outermost column of said plurality of columns of holes and said corresponding adjacent lateral edge of said base film.

29. The stretch film according to claim 3, wherein said at least one reinforcement strip is arranged on each lateral edge of said base film.

30. The stretch film according to claim 3, wherein said at least one lateral edge of said base film is hemmed.

31. The stretch film according to claim 29, wherein said at least one reinforcement strip and said at least one lateral edge of said base film are hemmed together.

32. The stretch film according to claim 29, wherein said at least one lateral edge of said base film and said at least one reinforcement strip are connected together in a substantially smooth manner, and without any wrinkles, and wherein said at least one reinforcement strip extends as far as said at least one lateral edge of said base film.

33. The stretch film according to claim 3, wherein said at least one reinforcement strip is inseparably fixed to said base film.

34. The stretch film according to claim 3, wherein said at least one reinforcement strip is indistinguishable from said base film.

35. The stretch film according to claim 3, wherein an interfacial area is provided in said area of contact between said at least one reinforcement strip and said base film, wherein said at least one reinforcement strip comprises polymer chains and said base film comprises polymer chains, said interfacial area being an area in which said polymer chains of said base film mix with said polymer chains of said at least one reinforcement strip.

36. The stretch film according to claim 3, wherein a transition area extends from said at least one lateral edge of said at least one reinforcement strip to said base film, and wherein said transition area is smooth and does not have any notches.

37. The stretch film according to claim 3, wherein said at least one reinforcement strip is thermally laminated to said base film.

38. The stretch film according to claim 3, wherein said at least one reinforcement strip is fixed to said base film in a substantially smooth manner, and without any wrinkles.

39. The stretch film according to claim 3, wherein said base film and said at least one reinforcement strip are pre-stretched in said main direction and/or in a transverse direction perpendicular to said main direction, before or after formation of said plurality of holes.

40. The stretch film according to claim 3, wherein said plurality of holes have at least one shape selected from the group of shapes consisting of substantially four-cornered and ellipsoidal.

41. The stretch film according to claim 3, wherein a portion of said base film between two adjacent holes of said plurality of holes in the same column of said plurality of columns is stretched more than the rest of said base film in a direction perpendicular to said main direction.

* * * * *